US008402712B2

(12) United States Patent
Ahearn

(10) Patent No.: US 8,402,712 B2
(45) Date of Patent: Mar. 26, 2013

(54) METHOD AND APPARATUS FOR CONSTRUCTION OF BUILDINGS

(76) Inventor: Michael Ahearn, Cypress, TX (US)

( * ) Notice: Subject to any disclaimer, the term of this patent is extended or adjusted under 35 U.S.C. 154(b) by 0 days.

(21) Appl. No.: 12/932,458

(22) Filed: Feb. 25, 2011

(65) Prior Publication Data

US 2011/0203216 A1 Aug. 25, 2011

Related U.S. Application Data

(60) Provisional application No. 61/338,904, filed on Feb. 25, 2010.

(51) Int. Cl.
*E04H 12/00* (2006.01)

(52) U.S. Cl. ..... 52/655.1; 52/653.2; 52/836; 52/852

(58) Field of Classification Search ..... 52/653.1, 52/655.1, 653.2, 834, 836, 843, 852
See application file for complete search history.

(56) References Cited

U.S. PATENT DOCUMENTS 3,813,837 A * 6/1974 McClain et al. ..... 52/309.1
3,966,342 A * 6/1976 Moriya ..... 403/256
4,104,838 A * 8/1978 Hage et al. ..... 52/239
4,142,343 A * 3/1979 Trafton ..... 248/219.1
4,194,338 A * 3/1980 Trafton ..... 403/305
4,458,455 A * 7/1984 Tollstoff de Voss ..... 52/38
4,570,408 A * 2/1986 Frascaroli et al. ..... 52/843
4,805,365 A * 2/1989 Bastian ..... 52/282.2
4,941,763 A * 7/1990 Euteneuer ..... 403/3
5,240,089 A * 8/1993 Spera ..... 182/186.7
5,979,119 A * 11/1999 Trafton ..... 52/40
6,505,453 B1 * 1/2003 Rixen et al. ..... 52/655.1
6,634,824 B2 * 10/2003 Liu ..... 403/217
7,178,765 B2 * 2/2007 Huang ..... 248/122.1
7,578,110 B2 * 8/2009 Jenkins ..... 52/655.1
7,823,347 B1 * 11/2010 Blinn ..... 52/244
2006/0150572 A1 * 7/2006 Rawson-Harris ..... 52/736.2
2008/0178551 A1 * 7/2008 Porter ..... 52/653.1

* cited by examiner

*Primary Examiner* — Robert Canfield
*Assistant Examiner* — Babajide Demuren
(74) *Attorney, Agent, or Firm* — James L. Jackson

(57) ABSTRACT

A framework system for buildings and other structures having a plurality of structural columns each having a wall structure of generally circular cross-sectional configuration defining an internal chamber and having a number of pairs of elongate external undercut grooves extending the length of the column and defining internal elongate grooves also extending the length of the column. Structural framework members extend between adjacent ones of the structural columns and define opposed ends. Gripper members are mounted to the ends of each of the structural framework members and each have a pair of spaced hook-like lateral retainer flanges disposed in retaining engagement within the elongate external undercut grooves. A structural member extends the length of the internal chamber and has radially oriented structural flanges each being received within one of the internal elongate grooves.

11 Claims, 12 Drawing Sheets

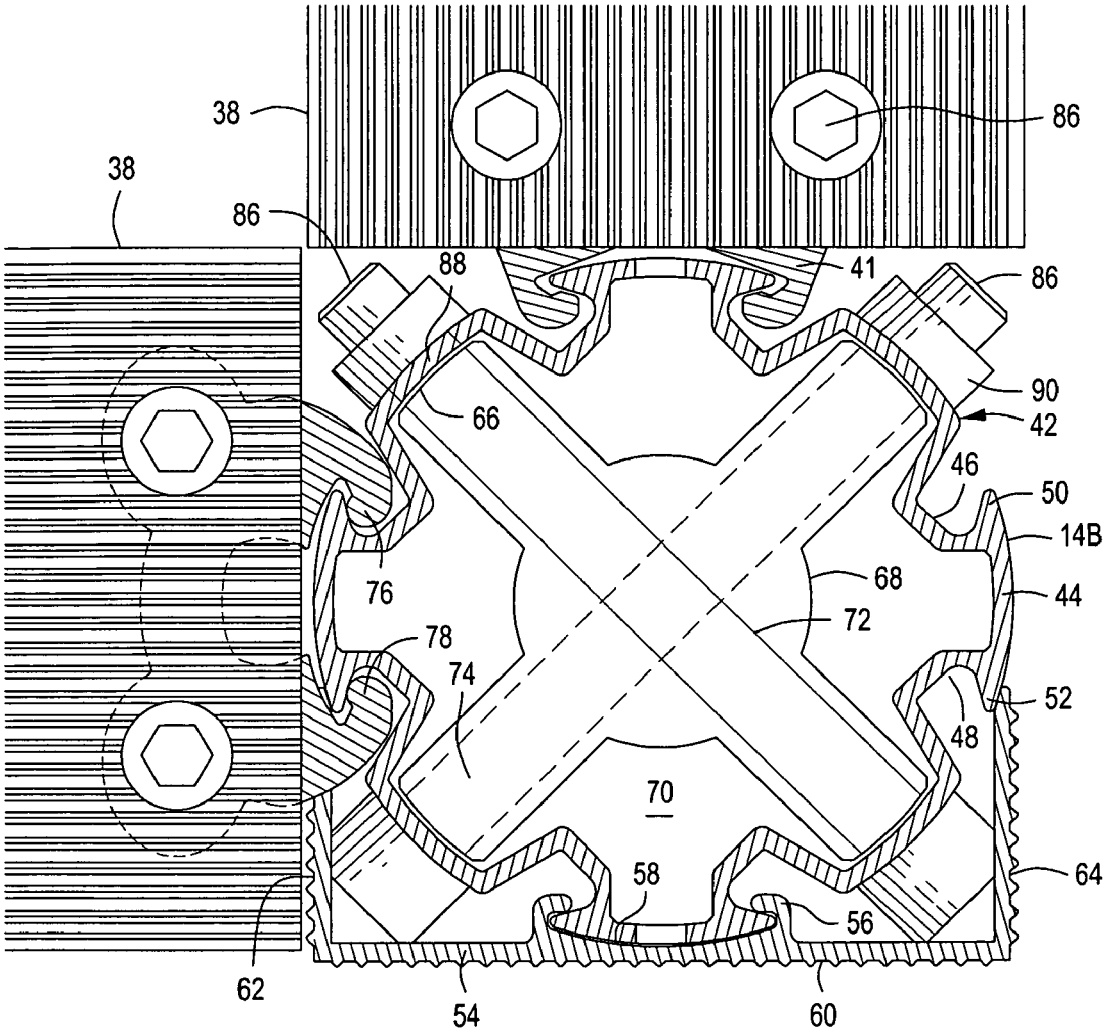
FIG. 10
FIG. 11
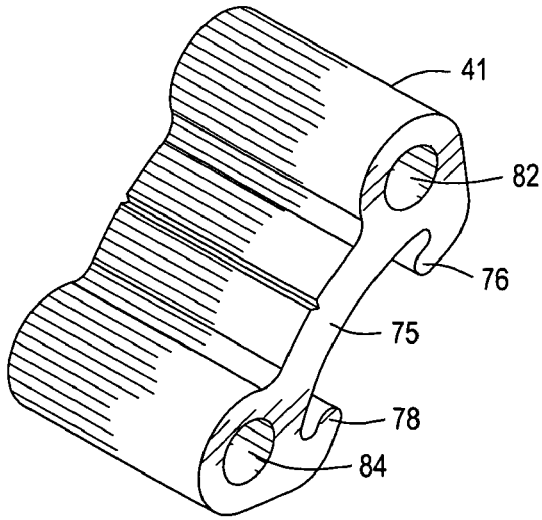

METHOD AND APPARATUS FOR CONSTRUCTION OF BUILDINGS

RELATED PROVISIONAL APPLICATION

Applicant hereby claims the benefit of U.S. Provisional Patent Application No. 61/338,904 filed on Feb. 25, 2010 by Michael Ahearn and entitled "Method and Apparatus for Construction of Buildings", which Provisional Patent Application is incorporated by reference herein for all purposes.

BACKGROUND OF THE INVENTION

1. Field of the Invention

The present invention relates generally to light-weight building structures that are designed particularly for environmentally friendly, i.e., green design and construction, without sacrificing from the standpoint of durability and serviceability. The present invention also concerns building framework systems that are designed to incorporate light-weight structural components that are manufactured by molding and/or extrusion operations and scrap or damaged components can be easily recycled, thus enhancing the environmentally friendly characteristic of the building framework system.

2. Description of the Prior Art

A predecessor to the building framework construction system of the present invention is disclosed in U.S. Pat. Nos. 4,142,343; 4,194,338 and 5,979,119 of Ronald H. Trafton. In each case hollow support posts are provided having external longitudinal grooves which are designed to receive the connector elements of brackets that may be moved to desired positions along the lengths of the grooves and locked into place by clamping action or by other locking means. The support posts may have single, generally cylindrical walls or concentric internal and external spaced primary and secondary post walls as desired. Other prior art patents also show the use of structural posts having various types of connector members which permit simple and efficient assembly of a building framework.

SUMMARY OF THE INVENTION

It is a principal feature of the present invention to provide a novel building framework system that is designed and engineered for ease of assembly in a minimal amount time and with a minimal number of construction workers;

It is another feature of the present invention to provide a novel building framework system that may be assembled through the use of simple and readily available tools and relatively unskilled workers, thus minimizing the cost of building construction.

It is another feature of the present invention to provide a novel building framework system having structural components that are composed of a metal material that is easily recovered and used for the manufacture of other similar components, thus minimizing waste of material and benefiting the environment by minimizing the waste that would ordinarily be disposed of in landfills;

It is also a feature of the present invention to provide a novel building framework system that practically eliminates material waste by utilizing materials, such as aluminum or aluminum alloy so that any damaged components can be easily melted and used to for extrusion or molding other building framework components;

It is another feature of the present invention to provide a novel building framework system having tubular columns or posts defining external grooved geometry to permit selective assembly of lateral connector members thereto and defining an internal chamber permitting insertion of structural members therein for enhancing the structural integrity and load carrying capacity of the tubular columns or posts;

It is a feature of the present invention to provide a novel construction framework system having efficient structural connections between columns and having joints that are at least as strong as the column material itself in compression, tension, torsion, bending, and shear so that if a structure yields, the yielding should not occur at the joints;

It is another feature of the present invention to provide a novel construction framework system that enables a construction system that exceeds known historic construction methods, thus facilitating superstrong highly engineered applications such as towers, domes, bridges, curved spans, offshore oil rigs, power towers and facilitating seismic and hurricane-rated buildings and other structures;

It is also a feature of the present invention to provide a novel construction framework system that is as universal as possible, thus facilitating a system approach that has the fewest pieces and works in the great majority of different kinds of connections, at many different angles, and with multiple columns coming to the same intersection, and intersections of different size columns.

It is an even further feature of the present invention to provide a novel construction framework system that is preferably standardized by being based on extruded parts, with a minimum of post-processing and a minimum number of assembly pieces.

is another feature of the present invention to provide a novel construction framework system that effectively maintain architectural appeal (by being completely internal) so it can be used inside walls or exposed where the frame will be featured as an aspect of the look and feel of the structure.

Briefly, a framework structure for a building or other structural installation, according to the present invention, employs a column or post profile which is extruded, and then cut to desired length and prepared with two columns or posts being used to form a structural framework connection. The column or post geometry defines an internal chamber or receptacle within which inserts of differing cross-sectional geometry are positioned and secured. The inserts become like 'plugs' that make a section inside the column have the characteristic of being virtually solid. In one column, the solid insert section is bolted in place at the joint, and in the faying column, the solid section is located within the end portion of the column and is bolted in place. The connection insert extends from one solid plug member to another, using a structural bolt in the center. The plug for the faying column would be bolted to the other plug to simulate and emulate a continuous plug, and then the faying column would be slipped over the plug and bolted in place. This feature results in the formation of a column or post structure of any desired length and having exceptional resistance to bending as the framework is subjected to wind, rain or snow loading.

This arrangement will be amenable to standardization, and also to special framework designs, thus simultaneously solving a variety of design requirements. The structurally enhanced column construction can be efficiently built in a factory environment for manufacturing accuracy and efficiency, and it can be changed in the field environment such as by re-drilling the bolting holes in a new joint location. This connector will also work well as a slab anchor. A section of the insert profile is bolted to the slab foundation. Then the column shell is slipped over the insert section and is secured to it by means of bolts or other suitable connectors. All the X and Y axis fit issues can be solved by astute tolerancing. The structure that is in progress becomes the fixture for accurate anchor placement and simplifies framework assembly. This is a universal column intersection solution that realizes structural potential that has not previously been achieved.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing a building framework that is constructed according to the principles of the present invention;

FIG. 2 is an elevation view showing the right side of the building framework of FIG. 1, the framework being supported by a foundation such as a concrete slab foundation;

FIG. 3 is a partial isometric illustration showing the front section of the building framework of FIGS. 1 and 2 and showing an overhead door mechanism mounted to the front wall portion of the framework;

FIG. 4 is an elevation view showing the left side of the building framework of FIGS. 1 and 2;

FIG. 5 is an elevation view showing the rear portion of the building framework of FIGS. 1-3;

FIG. 6 is a fragmentary isometric illustration showing the upper left front corner of the building framework structure of FIG. 1 in greater detail;

FIG. 7 is a fragmentary isometric illustration showing the lower left front corner of the building framework structure of FIG. 1 in greater detail;

FIG. 8 is a fragmentary isometric illustration showing the upper right rear corner of the building framework structure of FIG. 1 in greater detail;

Figure 1:
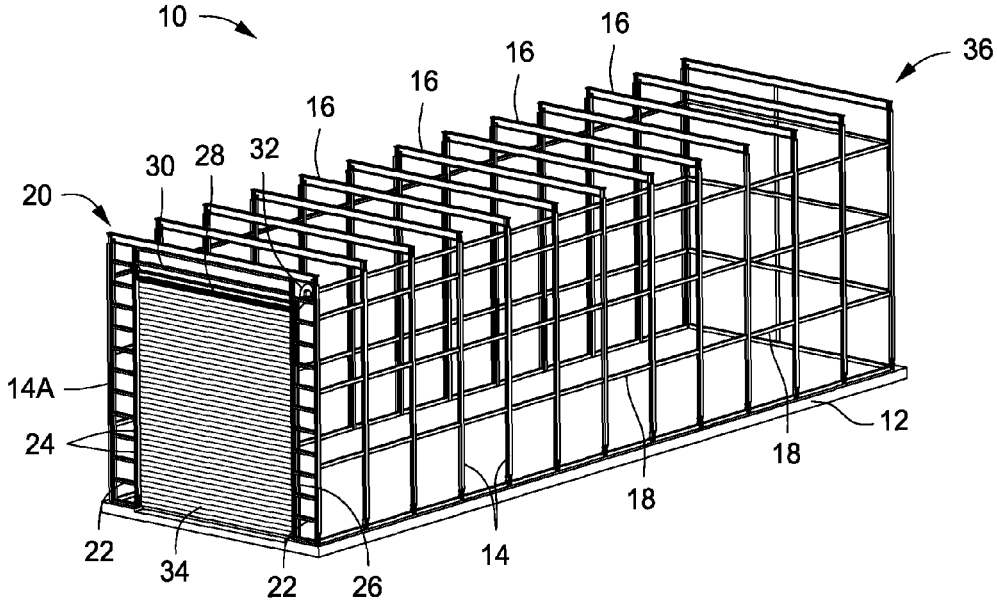
Figure 9:
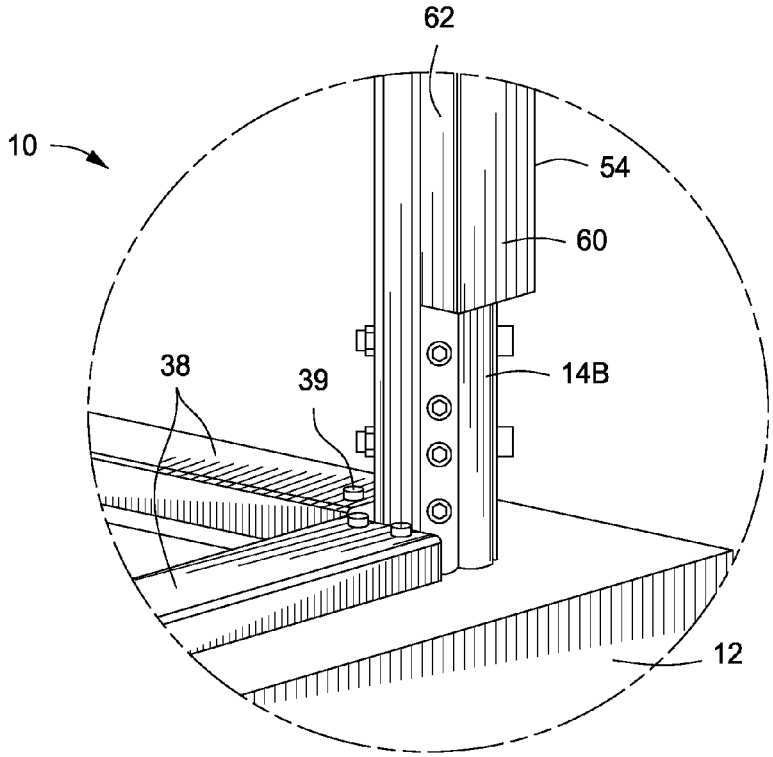
Figure 12:
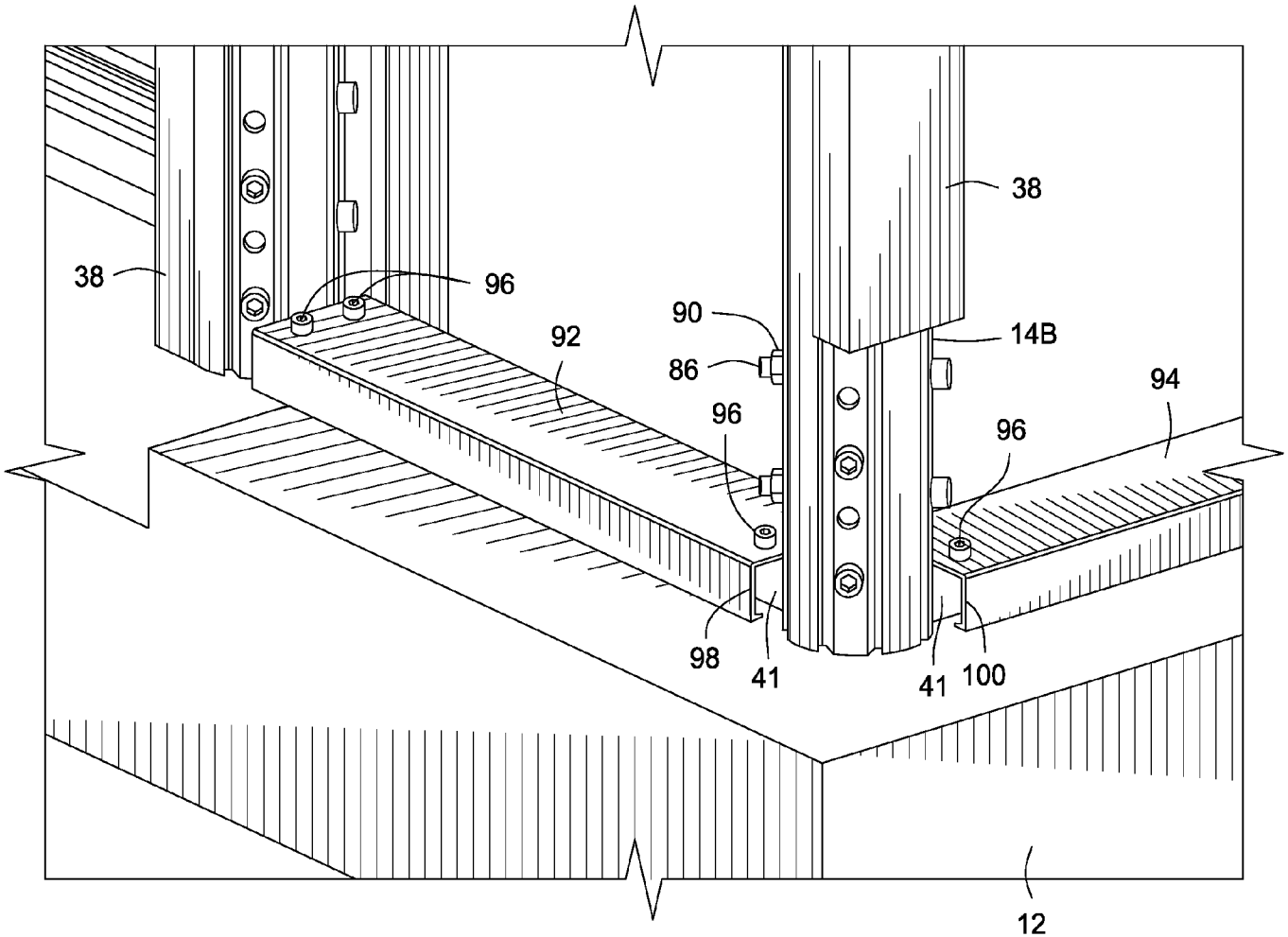
Figure 13:
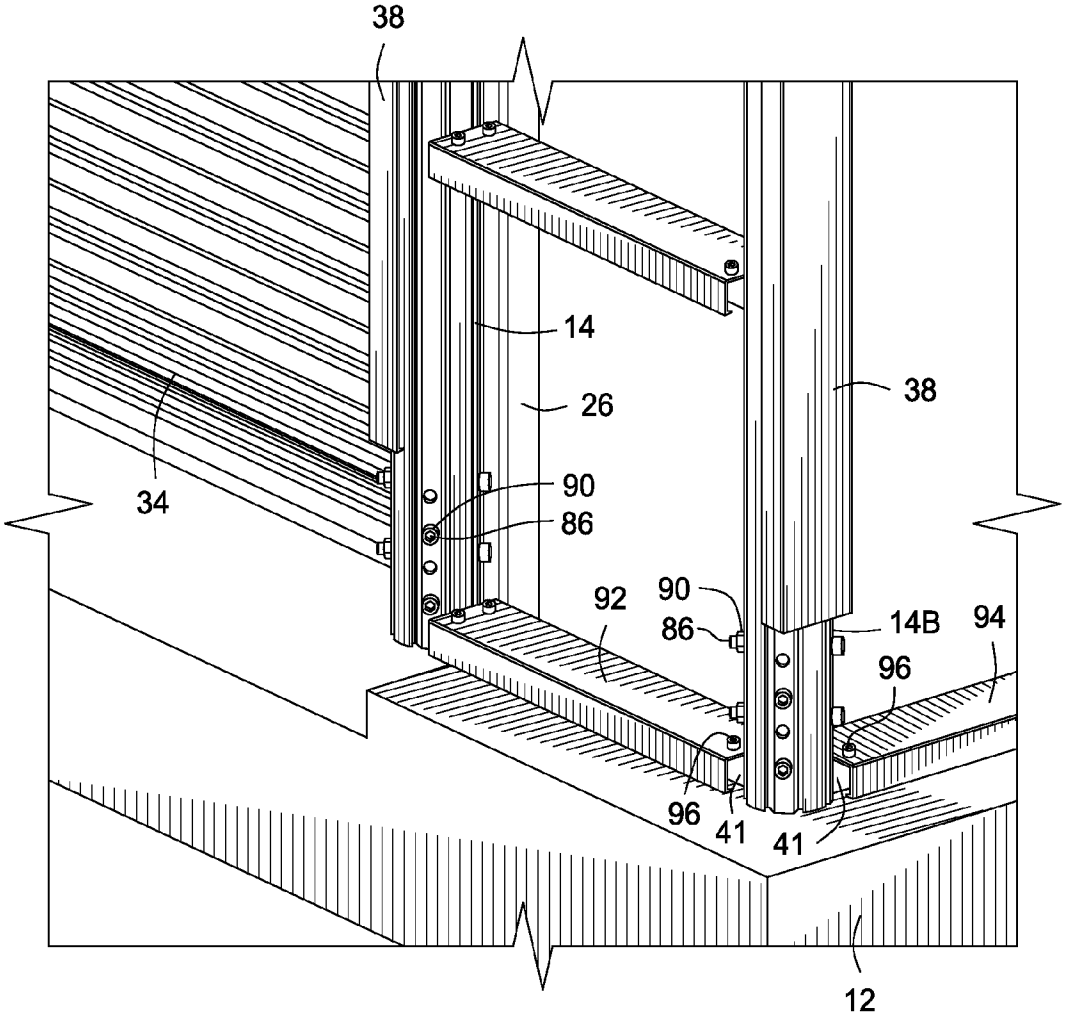
Figure 14:
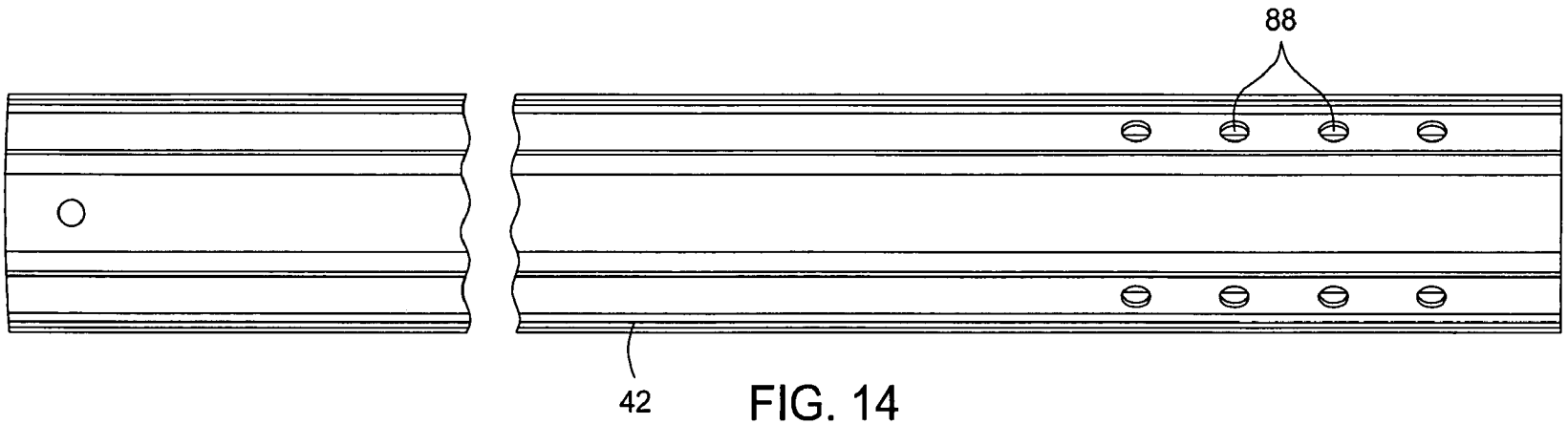
Figure 15:
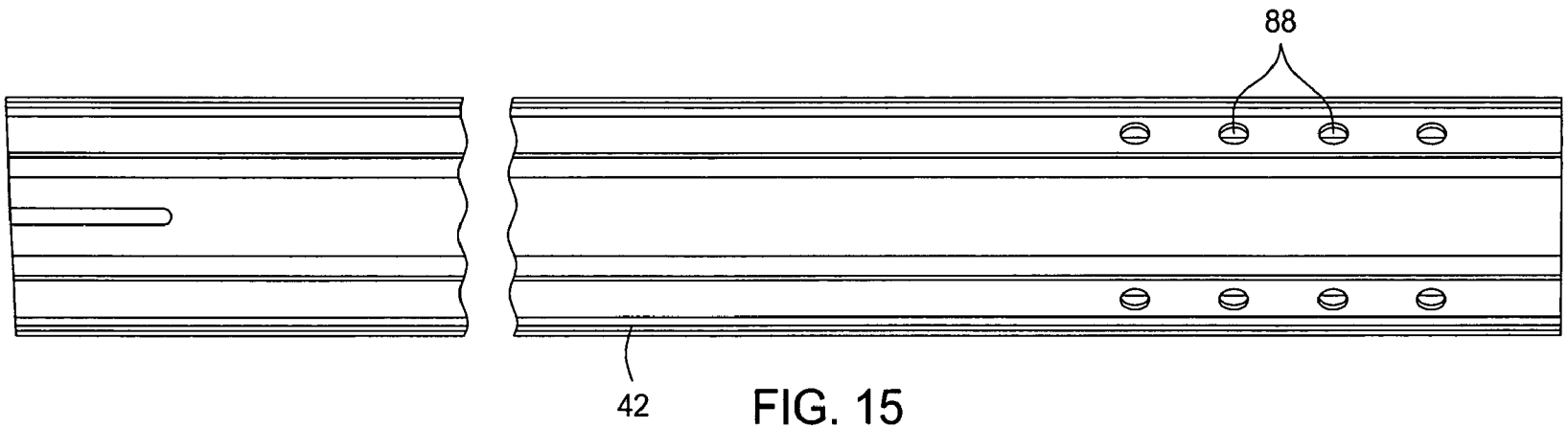
Figure 16:
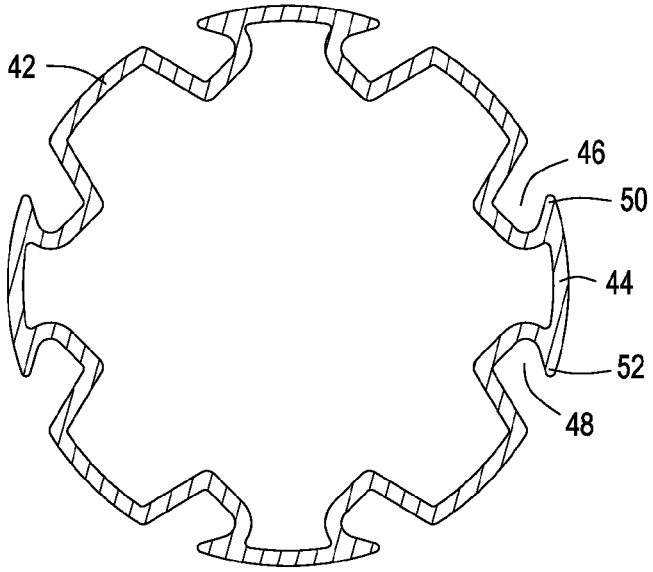
Figure 17:
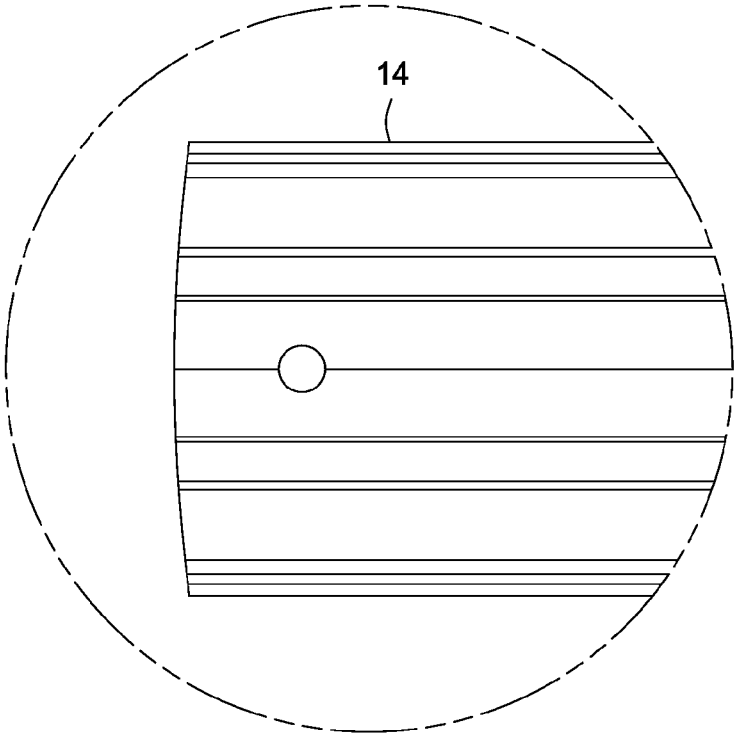
Figure 18:
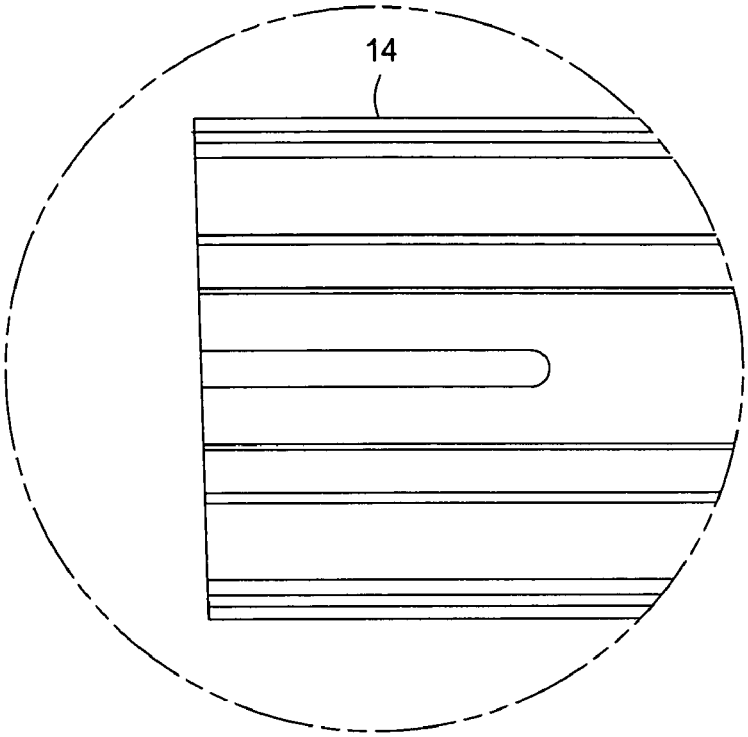
Figure 19:
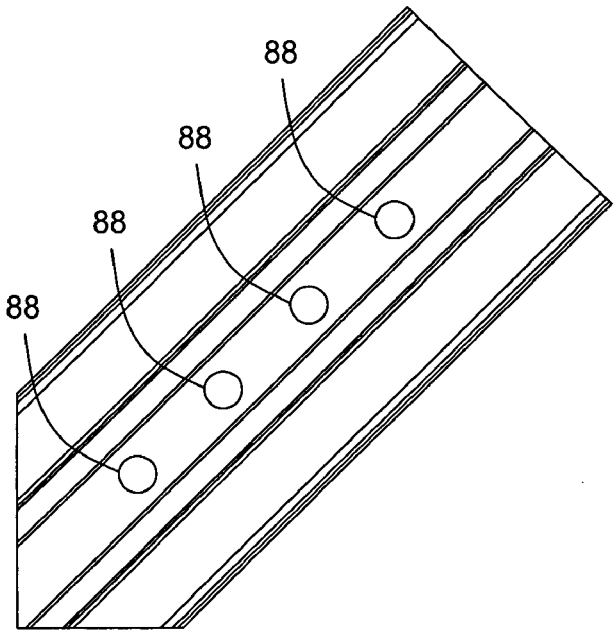
Figure 20:
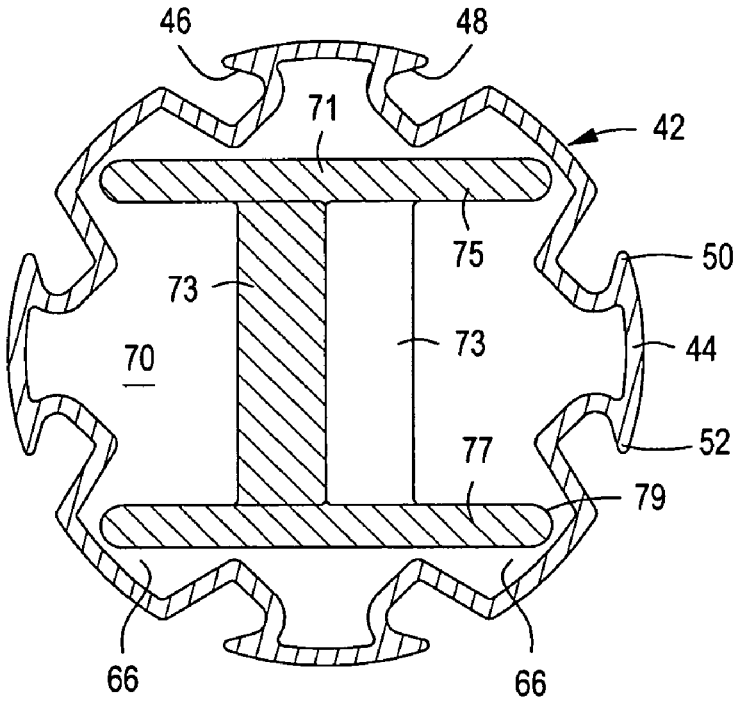

FIG. 9 fragmentary isometric illustration showing the lower right rear corner of the building framework structure of FIG. 1 in greater detail;

FIG. 10 is a partial sectional view in plan, showing a portion of the building framework of FIG. 1 and further showing a support column of the building framework being arranged at a corner of the framework;

FIG. 11 is an isometric illustration showing a gripper member of the building framework in detail;

FIG. 12 is a fragmentary isometric illustration showing the lower portions of support column assemblies being integrated with other framework components to form the front wall and lower right corner of the building framework of FIG. 1 and further showing the building framework being supported by a foundation structure;

FIG. 13 is a fragmentary isometric illustration showing the lower portions of support column assemblies being integrated with transverse framework components to form the front wall and lower right corner and door opening of the building framework of FIG. 1;

FIG. 14 is an elevation view showing a major portion of the column shell structure of FIG. 9 and further showing the bolt hole pattern at the bottom portion of the column shell;

FIG. 15 is an elevation view similar to that of FIG. 10, but being rotated from the position of FIG. 10 to illustrate further details of the column shell;

FIG. 16 is a sectional view showing the column shell structure of one of the support column assemblies of the building framework of FIG. 1;

FIG. 17 is a partial elevation view showing an end portion of the column shell of FIGS. 10 and 15;

FIG. 18 is another partial elevation view showing an end portion of the column shell of FIGS. 10, 14 and 15;

FIG. 19 is another elevation view showing a lower portion of the column shell of FIGS. 10, 14 and 15 and further illustrating the drill pattern for each of the bolt receiving ridges of the column shell and FIG. 20 is sectional view in plan, showing a column or post having external slotted geometry to receive gripper connection members and further showing an internal I-beam within the column to provide for structural enhancement load carrying capability of the column.

DETAILED DESCRIPTION OF PREFERRED EMBODIMENT

Figure 6:
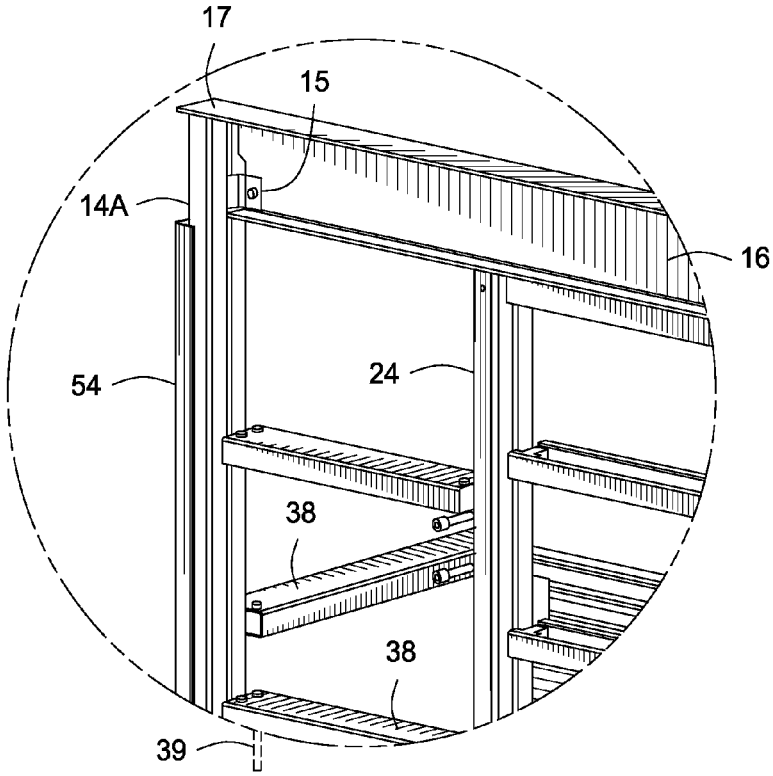
Figure 7:
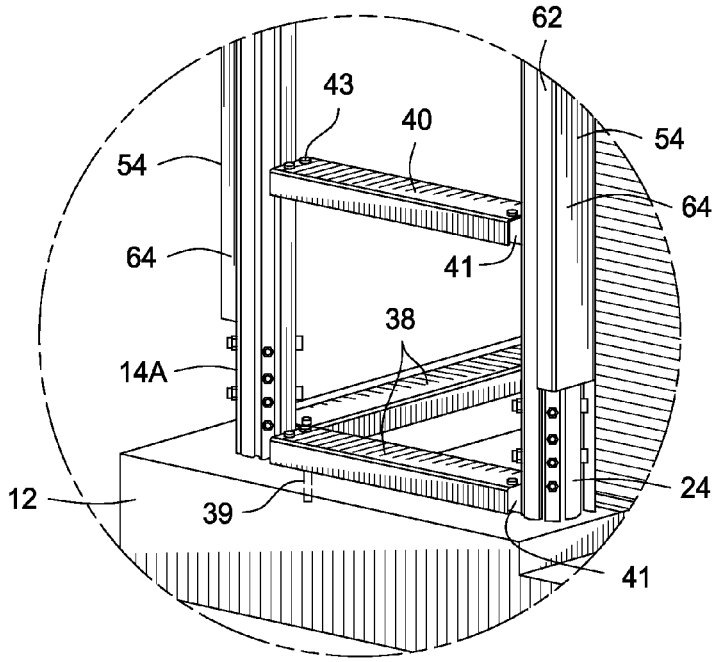
Figure 8:
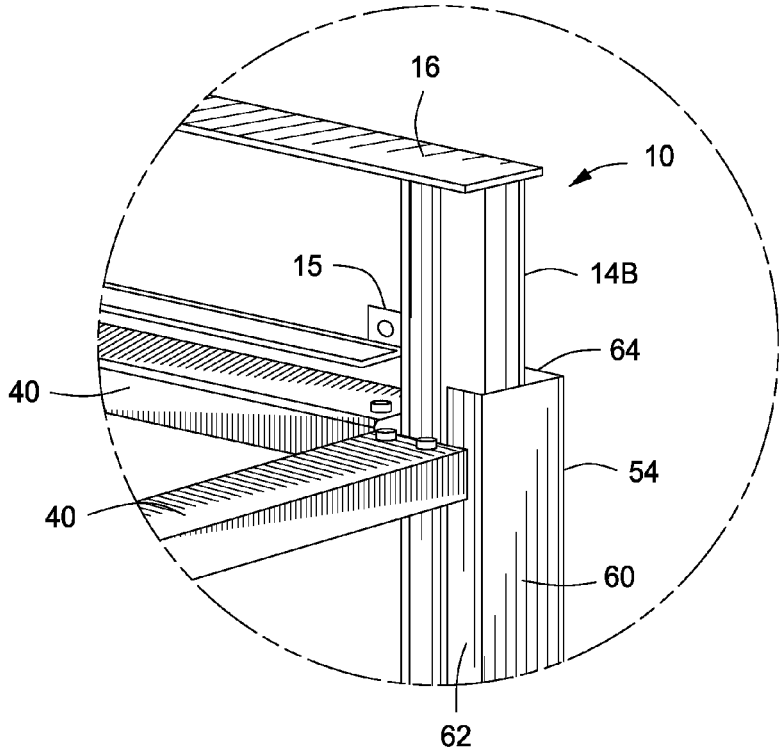

Referring now to the drawings and first to FIG. 1, a building framework, shown generally at 10 is supported on a foundation 12, which may conveniently take the form of a concrete slab foundation. The isometric illustration of FIG. 1 shows the front end portion of a building structure having an access opening that can be closed by an overhead door of conventional design. The framework 10 incorporates a number of framework support columns 14 that may have different treatment depending on their location with respect to the framework. For example, corner columns of a building framework structure may have different treatment as compared with interior columns, though the basic structure of each of the support columns is essentially the same. The building framework includes a plurality of roof rafter beams 16 having ends mounted to the upper end sections of the framework support columns 14 by means of beam connector members 15 as shown in FIGS. 1 and 6 and incorporating a plurality of transverse wall support structural members 18 that are mounted to and supported by the support columns 14. The connector members 15 have curved or hook-like retainer flanges such as shown at 76 and 78 of FIG. 11 and further incorporates a connector plate member having one or more bolt holes to enable bolted support of the roof rafter beam 16. Each of the roof beams having an upper flange 17 disposed in supported engagement with the upper ends of a pair of said structural support columns 14.

Figure 2:
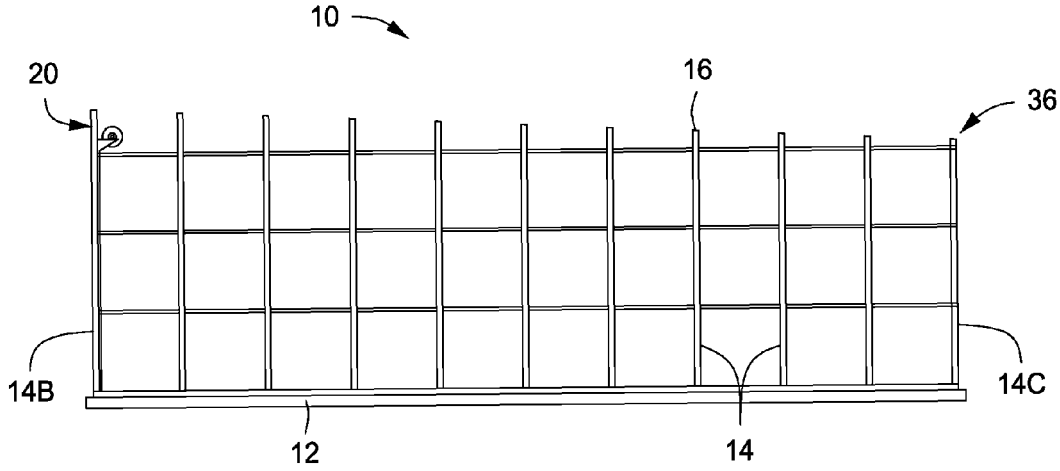
Figure 3:
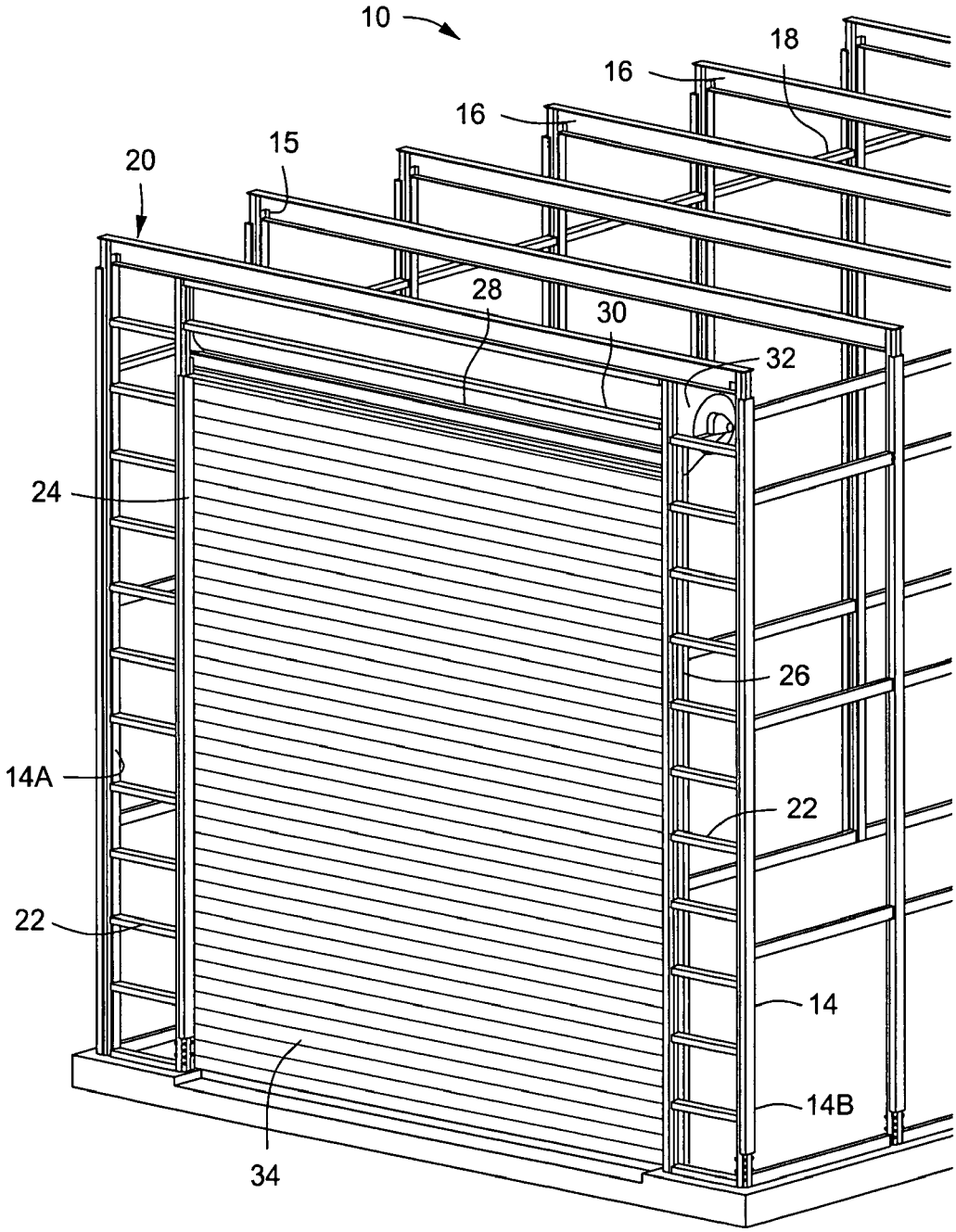
Figure 4:
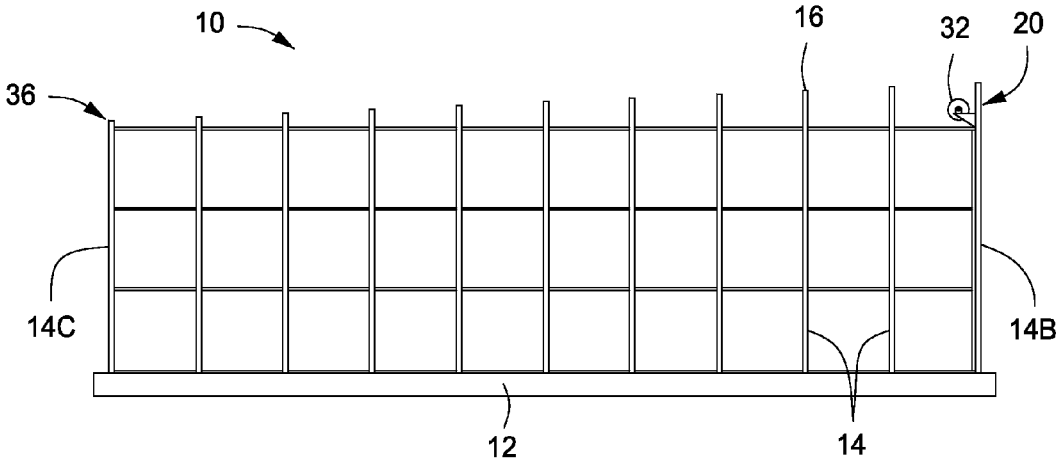

It is intended that the drawings and this specification represent a simple building structure that is constructed according to the principles of the present invention, it being understood that the building construction framework and its method of manufacture and assembly is applicable to a wide range of building structures, including multilevel buildings. The building framework 10 of FIG. 1 shows the front end wall and portions of the framework structure for the side walls and roof of the building. It should be noted that the roof structure of the building is shown to be inclined from a maximum height at the front wall and slopes downwardly to the height of the rear wall as shown in FIGS. 2-4 to facilitate drainage of rain, melting snow and ice during adverse weather conditions. The front end wall, which is illustrated generally at 20 has corner support columns 14A and 14B from which extend transverse structural members 22 that provide for wall reinforcement and provide for support of door frame columns 24 and 26. The door frame structure and the front wall frame of the building framework is composed of a transverse door frame member 28 and by a transverse structural support member 30. An overhead door roller assembly 32 is supported by the front wall frame structure and provides a motorized or manually actuated door 34 that can be raised and lowered to open and close the access door of the building.

The horizontally oriented roof rafter beams 16 have end portions that are mounted to and supported by the various columns 14, 14A and 14B so that a roofing system, not shown, may be fixed to and supported by the roof rafter beams 16. Preferably the roofing system will be composed of metal roofing materials; however, the present invention is not intended to be limited to metal roofing systems, but may employ other types of roofing as well. Likewise, the outer walls of the building structure may be composed of weather resistant metal wall material or any other wall material that is normally used for the character and intended use of the building that is being constructed.

Figure 5:
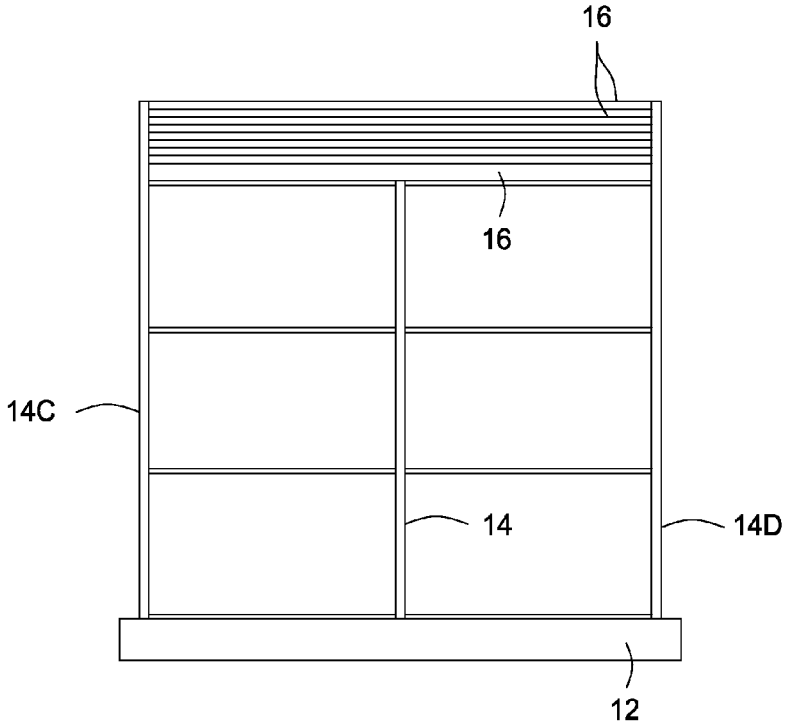

As shown in FIG. 5, the building framework 10 also includes a rear wall frame structure shown generally at 36 having corner support column members 14C and 14D and at least one interior support column 14 that is of appropriate length for the design height of the rear wall of the building structure. The slope of the roof of the building that is defined by the roof rafter beam members 16 is clearly evident in FIGS. 2 and 4.

With reference to the fragmentary isometric illustrations of FIGS. 6-9, mounting strip members 38 are mounted to the upper surface of the foundation 12, such as by means of retainer bolts 39 that are embedded in and extend from the foundation material. If desired, the retainer bolts may take the form of wedge type expansion anchor bolts that are secured within foundation holes or may be positioned within the foundation before it becomes hardened. The bottom portions of the corner columns 14A-14D and the interior support columns 14 are secured to end portions of the mounting strip members 38 by gripper members 41 that engage within pairs of external grooves of the columns or posts 14A or by column connection assemblies which will be discussed in detail in connection with FIGS. 10-14. If desired, the horizontally oriented mounting strip members 38 may simply be supported by the gripper members 41 at each end thereof, which have retaining engagement within the respective pairs of external grooves of the columns. A plurality of transverse structural members 40 also have end portions thereof connected with the corner columns 14A and with the door frame columns 24 and 26 by means of similar gripper members 41. Retainer bolts 43 extend through the transverse structural members 38 and 40 and secure the transverse structural members to the gripper members 41. Likewise, the transverse wall support structural members 18 have end portions thereof connected with the interior columns 14 by gripper members of similar design and function.

With reference now to FIG. 10 a support column 14B is shown in cross-section and adjacent mounting strip members 54 are shown to be connected with the support column 14B by means of gripper members 41 which are shown in detail in FIG. 11. A gripper member may have any desirable length for the mechanical connection that is intended. Gripper members are typically cut to desired length from an extrusion composed of any suitable metal, such as an aluminum alloy for example, and then can be de-burred, cleaned and anodized to a desired color and protective surface characteristic. The support column 14B, like the other corner support columns 14B, C and D, is defined in part by an external column shell shown generally at 42 that is composed of an extruded material such as an aluminum alloy, for light weight, durability, corrosion resistance and recyclable nature. The external column shell 42 is of generally circular cross-sectional configuration and defines a plurality of external connection ridges 44 having undercut gripper grooves 46 and 48 and defining edge flanges 50 and 52. The geometry of the connection ridges 44 permits gripper members 40 or external plate or corner members 54 to be mounted to the corner or interior columns of the building framework to thus provide the columns with substantially planar surface portions that enable flat wall finish materials to be fixed in surface-to-surface relation therewith. The corner members 54 and/or external plate members each define internal connection projections 56 having receptacles 58 within which a connection ridge 44 of the external column shell 42 is received in interlocking relation. The corner members 54 and/or external plate members define generally planar external surfaces such as shown at 60, 62 and 64 to permit ease of mounting siding material to the building framework 10. The support columns and the attachments are relatively moveable linearly to desired positions for assembly.

The undercut gripper grooves 46 and 48 are adapted to receive the spaced hook-like lateral retainer flanges 76 and 78 of one or more types of gripper or connector members 41 as discussed below. The column shell 42 also defines a geometry forming four radially spaced column insert receptacles, one being shown at 66 in FIG. 10. An internal column structural member 68 is located within an internal chamber 70 of the external column shell 42 and defines a central section 72 of essentially cylindrical configuration, from which extends four radially oriented integral structural members or flanges, one being shown at 74. The radially oriented integral structural members or flanges are received within each of the four radially spaced column insert receptacles 66 of the column shell 42. The internal column structural member 68, with its radially oriented structural members 74 provides the support column assembly with characteristics of exceptional structural integrity to resist the flexing and bending that is caused by wind loads and other forces.

Other types of internal structural members may be placed within the internal chamber or receptacle 70 of the external column shell 42, for example as shown in FIG. 20. In this case an internal structural member 71 is in the form of an I-beam having a central web 73 and integral parallel flanges 75 and 77. The internal configuration of the column shell 42 permits sections of the internal structural member 71 to be inserted endwise into the internal chamber 70, with edges of the flanges 75 and 77 being received with internal channels 66 of the column shell. Lengths of the structural member 71 may be fixed in end to end relation by means of connector members that are bolted or otherwise affixed to the web and flanges of adjacent lengths of structural members. The central webs of adjacent internal structural members may be overlapped as shown in FIG. 20 and secured by means of bolts or other suitable connectors so that the desired length of the structural column may be easily arranged from standard length components as needed.

As shown in FIG. 11 the gripper members 41 are in the form of connector devices that each define a gripper body structure 75 having pair of spaced hook-like lateral retainer flanges 76 and 78 that are of a dimension and configuration to engage within the undercut gripper grooves 46 and 48 of the external column shell 42 as shown in FIGS. 10 and 12-15. The body structure 75 of the gripper members 40 each define at least one and preferably a plurality of bolt holes 82 and 84 that are internally threaded for engagement by the external threads of stud or bolt members 86. The external column shell 42 defines at least one and preferably a plurality of spaced bolt openings 88 through which the mounting bolts or studs 86 extend. Retainer nut members 90 are threaded to retainer stud members 86 and serve to secure the internal column structural member 68 to the external column shell 42.

The fragmentary isometric illustrations of FIGS. 13 and 14 illustrate in significant detail the mounting arrangement of the building framework 10 with respect to the foundation 12. Anchor plate members 92 and 94 are secured to the foundation 12 by means of anchor members and have gripper ends that are mounted thereto by means of connection bolts or studs 96. If desired the anchor plate members are provided with covering strips 98 and 100 which define substantially planar interior and exterior surfaces for mounting of siding material thereto.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A framework system for buildings and other structures, comprising:

a plurality of structural columns each having a wall structure of generally circular cross-sectional configuration defining an internal chamber a plurality of pairs of elongate external undercut grooves extending substantially the length thereof and defining a plurality of internal elongate grooves also extending substantially the length thereof;

a plurality of structural framework members extending between adjacent ones of said structural columns and each defining first and second ends;

gripper members being mounted to said first and second ends of each of said structural framework members and each having a pair of spaced hook-like lateral retainer flanges disposed in retaining engagement within said elongate external undercut grooves;

an elongate structural member being located within said internal chamber and having radially oriented structural flange members each being received within one of said internal elongate grooves;

roof beams being positioned near upper end portions of said structural columns, said roof beams having beam flanges disposed in supported engagement with upper ends of said structural columns;

roof beam connector members being mounted to said roof beams and having hook-like flanges disposed in retaining engagement within said external grooves of said structural columns.

2. The framework system of claim 1, comprising:

said elongate structural member having a central portion and having a plurality of flanges radiating from said central portion and extending laterally into said internal elongate grooves.

3. The framework system of claim 1, comprising:

each of said plurality of structural columns each having a defined length and defining an internal chamber; and said elongate structural member being located within said internal chamber and having a central portion and having a plurality of flanges radiating from said central portion and extending laterally into said internal elongate grooves, said structural member extending substantially said defined length and providing said structural columns with enhanced resistance to bending.

4. The framework system of claim 3, comprising:

bolt members extending through said column wall structure and through said radially oriented structural members and securing said elongate structural member in substantially immovable relation within said structural column.

5. The framework system of claim 4, comprising:

said elongate structural member having a central portion of generally cylindrical configuration; and said radially oriented structural members projecting radially from said generally cylindrical central portion.

6. A framework system for buildings and other structures, comprising:

a plurality of structural columns each having a wall structure of generally circular cross-sectional configuration defining an internal chamber a plurality of pairs of elongate external undercut grooves extending substantially the length thereof and defining a plurality of internal elongate grooves also extending substantially the length thereof;

a plurality of structural framework members extending between adjacent ones of said structural columns and each defining first and second ends;

gripper members being mounted to said first and second ends of each of said structural framework members and each having a pair of spaced hook-like lateral retainer flanges disposed in retaining engagement within said elongate external undercut grooves; and an elongate structural member being located within said internal chamber and having radially oriented structural flange members each being received within one of said internal elongate grooves;

roof beams being positioned near upper end portions of said structural columns, said roof beams having beam flanges having supported engagement with upper ends of said structural columns; and roof beam connector members being mounted to said roof beams and having hook-like flanges disposed in retaining engagement within said external grooves of said structural columns.

7. The framework system of claim 6, comprising:

each of said framework support columns having an external column shell of desired length and defining a plurality of external connection ridges extending the length of said support column and each having opposed undercut edge flanges defining spaced undercut gripper grooves;

at least one of said external connection ridges and spaced undercut gripper grooves receiving hook-like lateral retainer flanges of a gripper member securing said external column shell of said framework support column to another framework member; and an external corner member having substantially planar wall structure and defining an internal receptacle receiving said external connection ridge and securing said external corner member to said external column shell.

8. A framework system for buildings and other structures, comprising:

a plurality of structural columns each having a wall structure of generally circular cross-sectional configuration defining an internal chamber a plurality of pairs of elongate external undercut grooves extending substantially the length thereof and defining a plurality of internal elongate grooves also extending substantially the length thereof;

a plurality of structural framework members extending between adjacent ones of said structural columns and each defining first and second ends;

gripper members being mounted to said first and second ends of each of said structural framework members and each having a pair of spaced hook-like lateral retainer flanges disposed in retaining engagement within said elongate external undercut grooves; and an elongate structural member being located within said internal chamber and having radially oriented structural members each being received within one of said internal elongate grooves, said elongate structural member having a central portion and having a plurality of flanges radiating from said central portion and extending laterally into said internal elongate grooves;

each of said plurality of structural columns each having a defined length and defining an internal chamber;

said elongate structural member being located within said internal chamber and having a central portion and having a plurality of flanges radiating from said central portion and extending laterally into said internal elongate grooves, said structural member extending substantially said defined length and providing said structural columns with enhanced resistance to bending;

roof beams being positioned near upper end portions of said structural columns, said roof beams having beam flanges having supported engagement with upper ends of said structural columns; and roof beam connector members being mounted to said roof beams and having hook-like flanges disposed in retaining engagement within said external grooves of said structural columns.

9. The framework system of claim 8, comprising:

bolt members extending through said column wall structure and through said radially oriented structural members and securing said elongate structural member in substantially immovable relation within said structural column.

10. The framework system of claim 8, comprising:

said elongate structural member having a central portion of generally cylindrical configuration; and said radially oriented structural members projecting radially from said generally cylindrical central portion.

11. The framework system of claim 8, comprising:

each of said framework support columns having an external column shell of desired length and defining a plurality of external connection ridges extending the length of said support column and each having opposed undercut edge flanges defining spaced undercut gripper grooves;

at least one of said external connection ridges and spaced undercut gripper grooves receiving hook-like lateral retainer flanges of a gripper member securing said external column shell of said framework support column to another framework member; and an external corner member having substantially planar wall structure and defining an internal receptacle receiving said external connection ridge and securing said external corner member to said external column shell.

* * * * *